US009802441B2

(12) United States Patent
Douglas

(10) Patent No.: US 9,802,441 B2
(45) Date of Patent: Oct. 31, 2017

(54) MAGNETIC CHALK LINE

(71) Applicant: Dustin Douglas, Everett, PA (US)

(72) Inventor: Dustin Douglas, Everett, PA (US)

( * ) Notice: Subject to any disclaimer, the term of this patent is extended or adjusted under 35 U.S.C. 154(b) by 0 days.

(21) Appl. No.: 14/808,948

(22) Filed: Jul. 24, 2015

(65) Prior Publication Data

US 2016/0023507 A1 Jan. 28, 2016

Related U.S. Application Data

(60) Provisional application No. 62/028,418, filed on Jul. 24, 2014.

(51) Int. Cl.
*B44D 3/38* (2006.01)

(52) U.S. Cl.
CPC ..... *B44D 3/38* (2013.01)

(58) Field of Classification Search
CPC ..... B44D 3/38
USPC ..... 33/413, 414, 756, 758, 770
See application file for complete search history.

(56) References Cited

U.S. PATENT DOCUMENTS

| | | | | |
|---|---|---|---|---|
| 5,163,230 | A | 11/1992 | Gast | |
| 5,659,970 | A * | 8/1997 | Reedy | G01B 3/1056 33/755 |
| 6,370,790 | B1 * | 4/2002 | Stenger | G01B 3/1056 33/758 |
| 7,240,439 | B2 | 7/2007 | Critelli | |
| 7,334,344 | B2 | 2/2008 | Scarborough | |
| 7,946,053 | B2 * | 5/2011 | Huang | G01B 3/1056 33/758 |
| 8,381,411 | B2 * | 2/2013 | DeLaRosa | G01B 3/1056 33/758 |
| 9,163,918 | B2 * | 10/2015 | Ricalde | G01B 3/1056 |
| 2003/0167651 | A1 * | 9/2003 | Pedersen | G01B 3/1071 33/758 |
| 2009/0025237 | A1 * | 1/2009 | Alexander | B44D 3/38 33/414 |
| 2016/0052332 | A1 * | 2/2016 | DeLeo | B44D 3/38 33/414 |

* cited by examiner

*Primary Examiner* — G. Bradley Bennett

(57) ABSTRACT

A magnetic chalk line provides a powerfully magnetized fastener, which may be secured magnetically to any flat metal surface, such that it will remain secured when the line is drawn out of its spool and snapped. A hook end is provided which may be hooked to the edge of a surface, such as a steel plate, girder, wooden stud, or drywall sheet. A teardrop-shaped aperture is provided in the fastener, enabling the user to easily secure it to a nail head when working with wood or other non-metallic materials.

16 Claims, 2 Drawing Sheets

MAGNETIC CHALK LINE

CROSS-REFERENCE TO RELATED APPLICATIONS

This Application claims the benefit of U.S. Provisional Application No. 62/028,418, filed Jul. 24, 2014, which is hereby incorporated by reference.

STATEMENT REGARDING FEDERALLY SPONSORED RESEARCH OR DEVELOPMENT

Not Applicable

PARTIES TO A JOINT RESEARCH AGREEMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The invention relates generally to construction tools and accessories, and in particular to a magnetic chalk line. For roofers, steelworkers, electricians, pipefitters, and many other construction tradesmen, a chalk line has become an essential tool for creating a straight and true line for their work to proceed, unfortunately, securing the end of the chalk line has proven to be difficult and time consuming in some cases, forcing a second worker to hold the end of the line. This makes the process more labor intensive, costing the contractor time and money. A magnetic chalk line, which may be quickly and easily secured magnetically to any flat metal surface, and may also be secured to a nail head or the square edge of a vertical member, would resolve this problem.

SUMMARY OF THE INVENTION

Accordingly, the invention is directed to a magnetic chalk line. The end of the line provides a powerfully magnetized fastener, which may be secured magnetically to any flat metal surface, such that it will remain secured when the line is drawn out of its spool and snapped. A hook end is provided which may be hooked to the edge of a surface, such as a steel plate, girder, wooden stud, or drywall sheet. A teardrop-shaped aperture is provided in the fastener, enabling the user to easily secure it to a nail head when working with wood or other non-metallic materials.

Additional features and advantages of the invention will be set forth in the description which follows, and will be apparent from the description, or may be learned by practice of the invention. The foregoing general description and the following detailed description are exemplary and explanatory and are intended to provide further explanation of the invention.

BRIEF DESCRIPTION OF THE DRAWINGS

The accompanying drawings are included to provide a further understanding of the invention and are incorporated into and constitute a part of the specification. They illustrate one embodiment of the invention and, together with the description, serve to explain the principles of the invention.

DETAILED DESCRIPTION OF THE INVENTION

Figure 1:
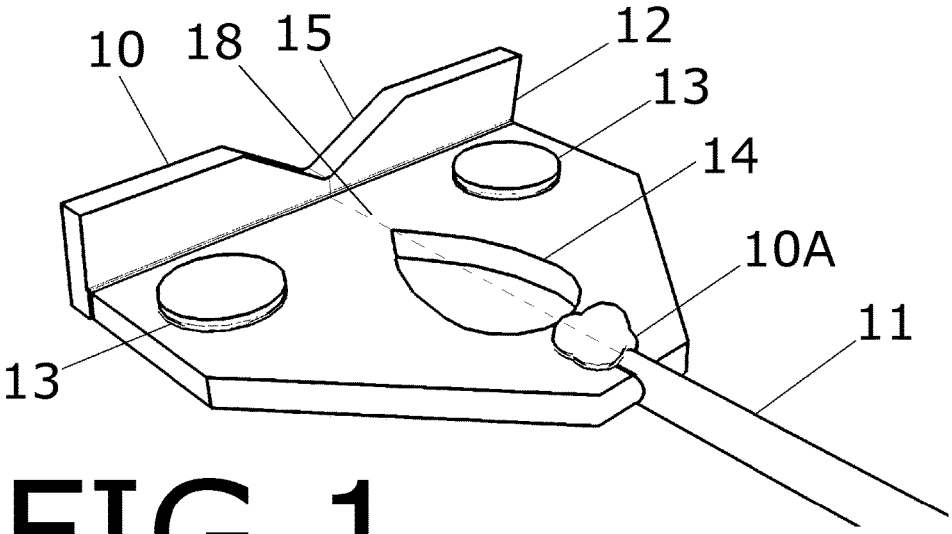
FIG. 1 shows a bottom perspective view of the fastener of the first exemplary embodiment, displaying the fastener 10, the hole 10A, the line 11, the hook end 12, the magnets 13, the aperture 14, and the notch 15.
Figure 2:
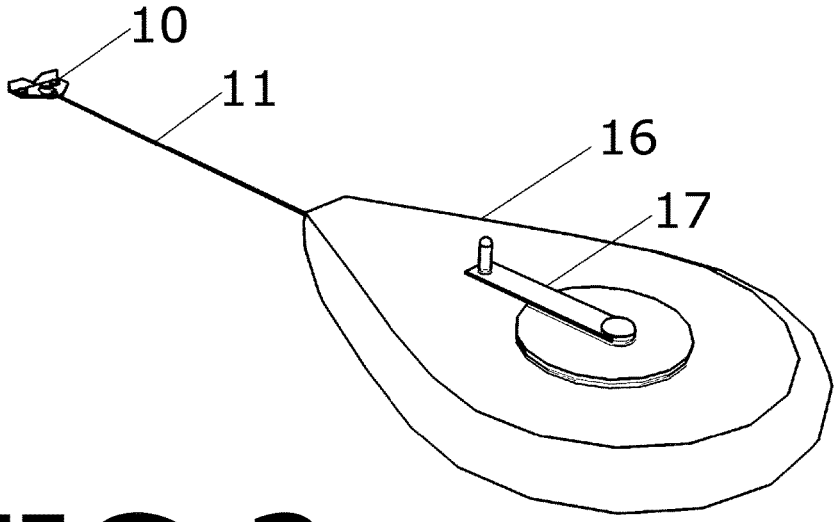
FIG. 2 shows a top perspective view of the first exemplary embodiment, displaying the fastener 10, the line 11, the spool 16, and the handle 17.
Figure 3:
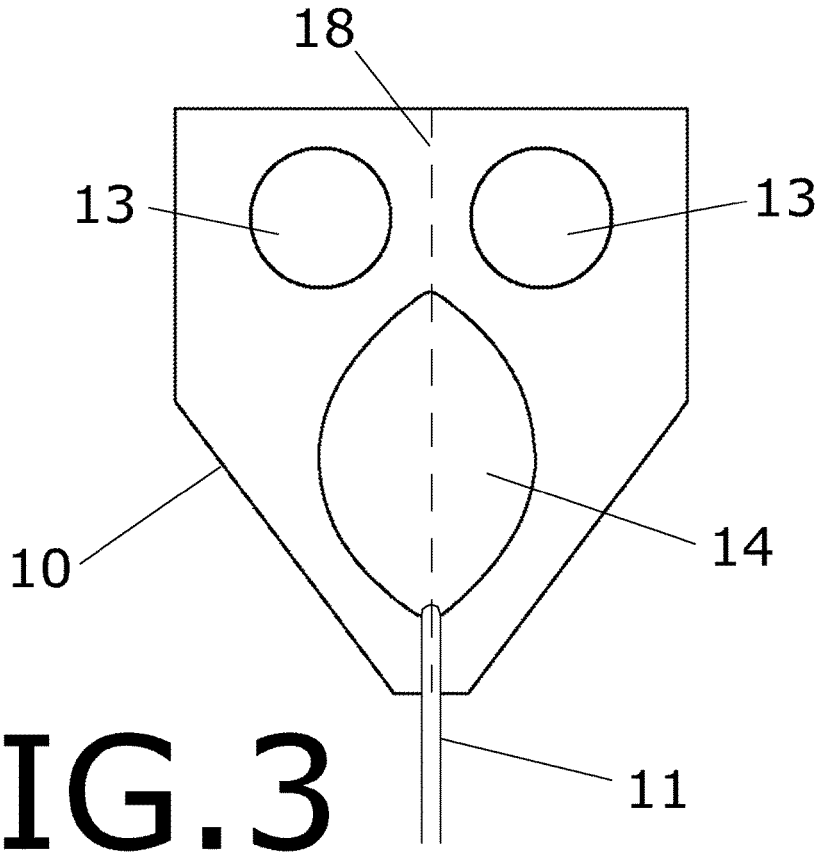
FIG. 3 shows a top view of the second exemplary embodiment, displaying the fastener 10, the chalk line 11, the magnets 13, the aperture 14, and the centerline 18.
Figure 4:
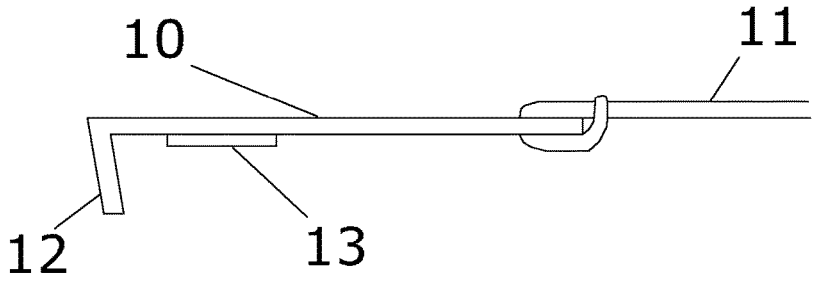
FIG. 4 shows a side view of the second exemplary embodiment, displaying the fastener 10, the chalk line 11, the hook end 12, and the magnets 13.

Referring now to the invention in more detail, the invention is directed to a magnetic chalk line.

The first exemplary embodiment is comprised of a conventional chalk line spool 16 with a crank handle 17, which provides a magnetic fastener 10 at the end of the chalk line 11. The fastener 10 may be secured magnetically to any flat metal surface, such that it will remain secured when the line is drawn out of its spool 15 and snapped. A hook end 12 is provided which may be hooked to the edge of a surface, such as a steel plate, girder, wooden stud, or drywall sheet. A teardrop-shaped aperture 14 is provided in the fastener 10, enabling the user to easily secure it to a nail head when working with wood or other non-metallic materials.

The flat side of the fastener 10 is preferably 1.375 inch in length and 1 inch in width. Preferably, from the hook end 12 to the center of the fastener is 5/16 inch to 3/8 inch on the flat side, which provides two powerful circular magnets 13. The magnets 13 are preferably 1/4 inch in diameter. Between the magnets 13 is a 3/8 inch, teardrop-shaped aperture 14 for sliding over a nail head. At the lower end on the fastener 10, a hole 10A is provided, preferably 3/16 inch in diameter, to attach the line 11.

Preferably, the hook end 12 is 1.25 inch in length and the height of the hook end 12 from the magnetic side of the fastener 10 is 1/4 inch, with a slight inward bevel rather than a true 90° angle. The center of the hook end 12 provides a V-shaped notch 15, which lines up along the centerline 18 of the fastener 10 with the center of the aperture 14 and the hole 10A. The notch 15 may be aligned with the user's mark by the user, when the chalk line 11 is snapped.

The second exemplary embodiment is comprised of a conventional chalk line spool 16 with a crank handle 17, which provides a magnetic fastener 10 at the end of the chalk line 11. The fastener 10 may be secured magnetically to any flat metal surface, such that it will remain secured when the line is drawn out of its spool 16 and snapped. A hook end 12 is provided which may be hooked to the edge of a surface, such as a steel plate, girder, wooden stud, or drywall sheet. An aperture 14 is provided in the fastener 10, which is shaped like a football, enabling the user to easily secure it to a nail head when working with wood or other non-metallic materials.

The flat side of the fastener 10 is preferably 1 inch in length and 7/8 inch in width. Preferably, from the hook end 12 to the center of the fastener is 1/2 inch. Preferably, from the hook end 12 to the magnets 13 is 1/16 inch. The magnets 13 are preferably 1/4 inch in diameter. Between the magnets 13 is a football shaped aperture 14 which is ⅜ inch wide and 9/16 inch long. The football shaped aperture 14 is used to attach the line 11.

Preferably, the hook end 12 is ⅞ inch in length and the height of the hook end 12 from the magnetic side of the fastener 10 is ¼ inch, with a slight inward bevel rather than a true 90° angle. The center of the hook end 12 provides a V-shaped notch 15, which lines up along the centerline 18 of the fastener 10 with the center of the aperture 14. The notch 15 may be aligned with the user's mark by the user, when the chalk line 11 is snapped.

To use the first or second exemplary embodiment, the user pulls the fastener 10 to draw a length of chalk line 11 from the spool 16, and secures the fastener 10 to a desired point, using the aperture 14, the hook end 12, the magnets 13, or some combination thereof as desired. The user then pulls the chalk line 11 taut and snaps the line 11 to create a mark. The user may then detach the fastener 10 and retract the line 11, using the crank handle 17 which is provided.

The fastener 10, the spool 15, and the handle 16 are preferably manufactured from rigid, durable materials such as steel, aluminum alloy, plastic, and copper alloy. The line 11 is preferably manufactured from a flexible, durable material, such as braided cotton or sisal fiber. Components, component sizes, and materials listed above are preferable, but artisans will recognize that alternate components and materials could be selected without altering the scope of the invention.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

I claim:

1. A magnetic chalk line, comprising:

(a) a spool;

(b) a chalk line;

(c) said spool comprising a crank handle; said crank handle being configured such that it retracts said chalk line when rotated;

(d) a fastener having a centerline;

(e) a hole;

(f) said hole being centered on said centerline;

(g) said fastener being affixed to an end of said chalk line by attaching said chalk line to said hole;

(h) said fastener having one or more magnets attached thereto, such that it may be removably attached to any metallic surface;

(i) said fastener having a hook end;

(j) said hook end being configured to removably attach to the edge of a surface;

(k) said fastener having an aperture; and (l) said aperture being centered on said centerline.

2. The magnetic chalk line of claim 1, wherein said chalk line is configured such that when snapped against a surface it leaves a chalk mark on said surface.

3. The magnetic chalk line of claim 1, wherein said hook end is at a slightly inward bevel and not at a ninety degree angle.

4. The magnetic chalk line of claim 2, wherein said hook end is at a slightly inward bevel and not at a ninety degree angle.

5. The magnetic chalk line of claim 1, wherein said hook end further comprises a v-shaped notch; said v-shaped notch being centered on said centerline.

6. The magnetic chalk line of claim 2, wherein said hook end further comprises a v-shaped notch; said v-shaped notch being centered on said centerline.

7. The magnetic chalk line of claim 3, wherein said hook end further comprises a v-shaped notch; said v-shaped notch being centered on said centerline.

8. The magnetic chalk line of claim 4, wherein said hook end further comprises a v-shaped notch; said v-shaped notch being centered on said centerline.

9. The magnetic chalk line of claim 1, wherein said aperture is tear drop shaped; a bulbous end of said tear drop shape being configured to face said chalk line.

10. The magnetic chalk line of claim 2, wherein said aperture is tear drop shaped; a bulbous end of said teardrop shape being configured to face said chalk line.

11. The magnetic chalk line of claim 1, wherein said aperture is football shaped.

12. The magnetic chalk line of claim 2, wherein said aperture is football shaped.

13. The magnetic chalk line of claim 9, wherein said hook end further comprises a v-shaped notch; said v-shaped notch being centered on said centerline.

14. The magnetic chalk line of claim 10, wherein said hook end further comprises a v-shaped notch; said v-shaped notch being centered on said centerline.

15. The magnetic chalk line of claim 11, wherein said hook end further comprises a v-shaped notch; said v-shaped notch being centered on said centerline.

16. The magnetic chalk line of claim 12, wherein said hook end further comprises a v-shaped notch; said v-shaped notch being centered on said centerline.

* * * * *